US007222559B2

(12) United States Patent
Wang

(10) Patent No.: US 7,222,559 B2
(45) Date of Patent: May 29, 2007

(54) SCREWDRIVER WITH TORQUE SETTING MECHANISM

(76) Inventor: Chun Fu Wang, No. 268, Fushin Rd., Puli Village, Nantou County (TW)

( * ) Notice: Subject to any disclaimer, the term of this patent is extended or adjusted under 35 U.S.C. 154(b) by 100 days.

(21) Appl. No.: 11/204,949

(22) Filed: Aug. 16, 2005

(65) Prior Publication Data

US 2007/0039425 A1 Feb. 22, 2007

(51) Int. Cl.

| | |
|---|---|
| ***B25B 23/14*** | (2006.01) |
| ***B25B 23/157*** | (2006.01) |
| ***B25B 23/142*** | (2006.01) |
| ***B25B 23/159*** | (2006.01) |

(52) U.S. Cl. ..... 81/467; 81/474; 81/475; 81/478; 81/480

(58) Field of Classification Search ..... 81/467, 81/473–476, 478, 480–483

See application file for complete search history.

(56) References Cited

U.S. PATENT DOCUMENTS 2,732,746 A * 1/1956 Livermont ..... 81/474

FOREIGN PATENT DOCUMENTS

DE 2114793 * 9/1972
DE 3704764 A1 * 9/1987

* cited by examiner

*Primary Examiner*—Joseph J. Hail, III
*Assistant Examiner*—Bryan R. Muller
(74) *Attorney, Agent, or Firm*—Pro-Techtor Int'l Services

(57) ABSTRACT

A screwdriver comprises a torque setting mechanism including a torque adjustment ring, an actuation rod threadedly secured to the upper torque adjustment ring and a lower torque adjustment nut, a spring biased sleeve with the actuation rod passed, and a clutch ring snugly put on two opposing intermediate flats of the actuation rod and having an upper surface engaged the torque adjustment ring and a lower surface formed with recesses engaged with steel balls on an upper surface of a support ring in the sleeve. Turning a rotatable handle will turn the sleeve. The clutch ring will disengage with the steel balls if the torque exceeds a set value. Thus, the torque exerted on the handle will not transmit to a shank secured to the actuation rod so as to prevent a screw from being over-driven by the shank.

5 Claims, 10 Drawing Sheets

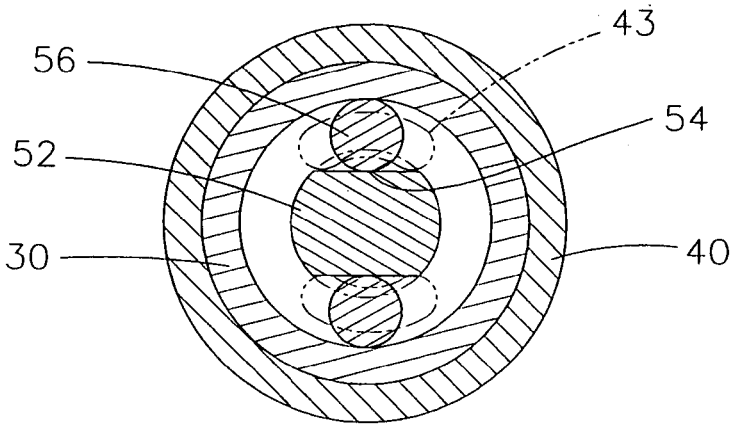
FIG .11-A
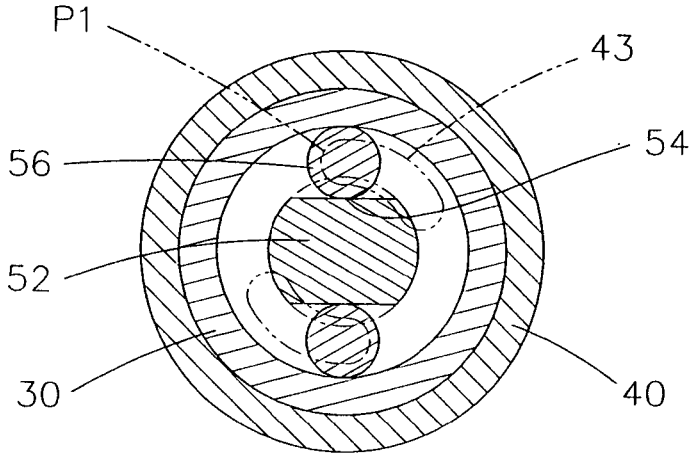
FIG. 11-B
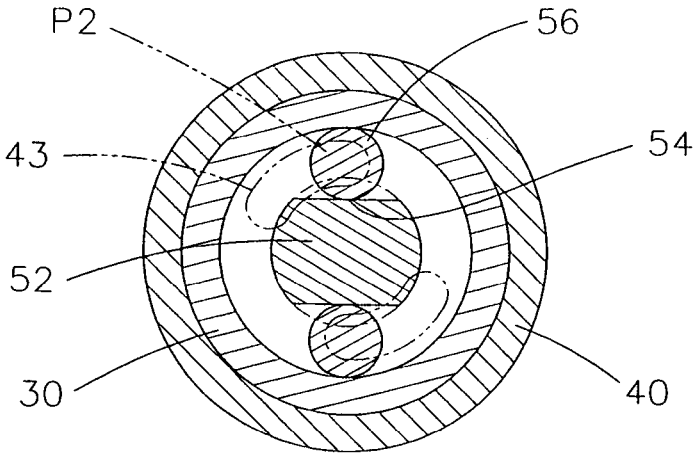
FIG. 11-C

SCREWDRIVER WITH TORQUE SETTING MECHANISM

BACKGROUND OF THE INVENTION

1. Field of Invention

The present invention relates to screwdrivers and more particularly to a screwdriver having a torque setting mechanism such that torque exerted on a handle will not transmit to a shank if the torque exceeds a set value so as to prevent a screw from being over-driven by the shank.

2. Related Art

Screwdrivers are well known. It is typical that tightness of a driven screw is determined based on experience of a person working on it. It is understood that in one case the screw may be damaged if force (i.e., torque) exerted thereon exceeds a set value thereof. Thus, it is highly desirable to provide a screwdriver with a torque setting mechanism. However, how to design a torque setting mechanism in a limited internal space of a screwdriver while operation convenience and other advantageous features are still provided is a task to be accomplished. Thus, continuing improvements in the exploitation of such screwdriver are constantly being sought.

SUMMARY OF THE INVENTION

It is therefore an object of the present invention to provide a screwdriver comprising a rotatable handle including a sleeve including an internal lower elastic member, a support ring urged against an internal shoulder by the elastic member, the support ring including a plurality of male members equally spaced around its upper surface, and a scale window on a surface of the handle; and a torque setting mechanism including an actuation rod passed the support ring and the elastic member and including a lower threaded section, an upper threaded section, two opposing intermediate flats extended from the upper threaded section to the lower threaded section, and a top socket for securely receiving one end of a shank; a clutch ring put on the flats and having a plurality of equally spaced female members formed on its lower surface for receiving portions of the male members; a torque adjustment ring rotatably provided on tops of the clutch ring and the handle with the actuation rod passed, the torque adjustment ring urged against a shoulder between the upper threaded section and the socket; a lower torque adjustment nut threadedly secured to the lower threaded section and provided under the sleeve to urge against a bottom of the elastic member; and a color ring provided at a bottom of the actuation rod and disposed corresponding to the scale window, the color ring being adapted to turn as the actuation rod longitudinally moves in a torque setting operation by turning the torque adjustment ring; wherein in a screw fastening operation fit an open end of the shank into the head of a screw, turn the handle to cause both the support ring and the torque adjustment ring to turn, the clutch ring disengages with the male members to move the torque adjustment ring upward if a torque exerted on the screw by the shank exceeds a set maximum torque value, and the actuation rod moves longitudinally such that the torque will not transmit to the shank so as to prevent the screw from being over-driven; and in a maximum torque value setting operation of a screw turn the torque adjustment ring about the upper threaded section to longitudinally move the actuation rod whereby moving the torque adjustment nut closer to the support ring will further compress the elastic member, and bring the clutch ring to further engage the support ring.

In one aspect of the present invention, the elastic member is a compression spring.

In another aspect of the present invention, the elastic member includes a plurality of resilient rings stacked together.

In yet another aspect of the present invention, the male members are steel balls and the female members are a plurality of recesses.

In a further aspect of the present invention, the male members are formed as teeth and the female members are formed as mated teeth.

The above and other objects, features and advantages of the present invention will become apparent from the following detailed description taken with the accompanying drawings.

BRIEF DESCRIPTION OF THE DRAWINGS

FIGS. 11A, 11B, and 11C are transverse sectional views showing relative positions of steel balls in cavities when the direction change member turns.

DETAILED DESCRIPTION OF THE INVENTION

Figure 1:
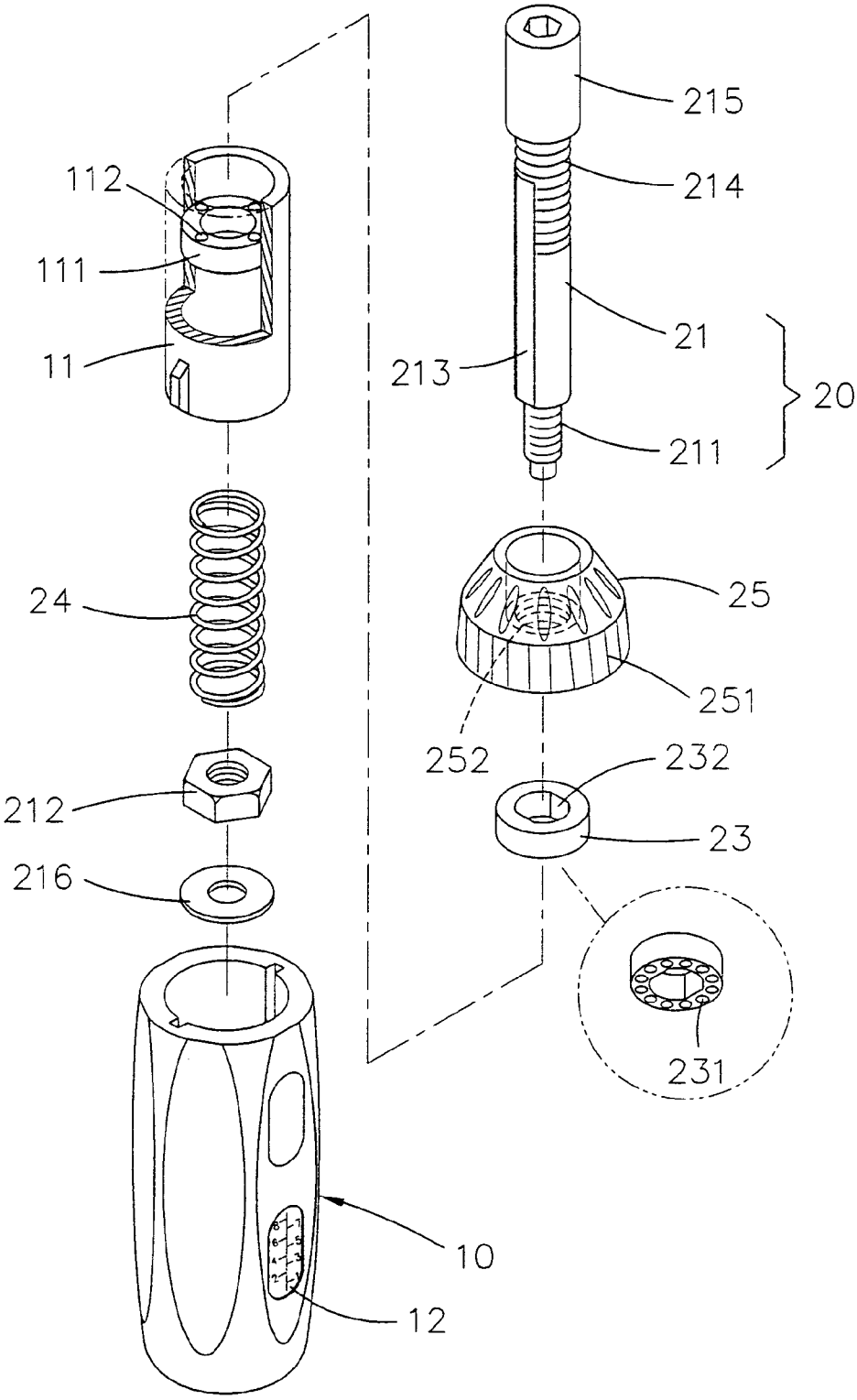
FIG. 1 is an exploded view of a first preferred embodiment of screwdriver according to the invention.
Figure 2:
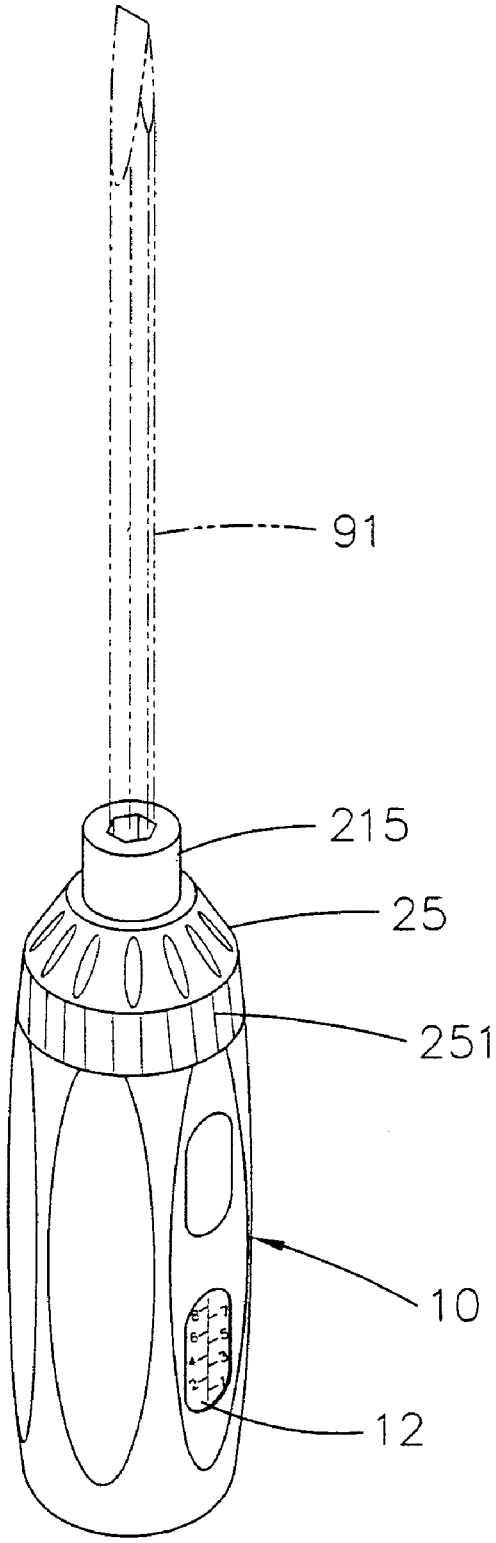
FIG. 2 is a perspective view of the assembled screwdriver in FIG. 1 where a shank is mounted.
Figure 3:
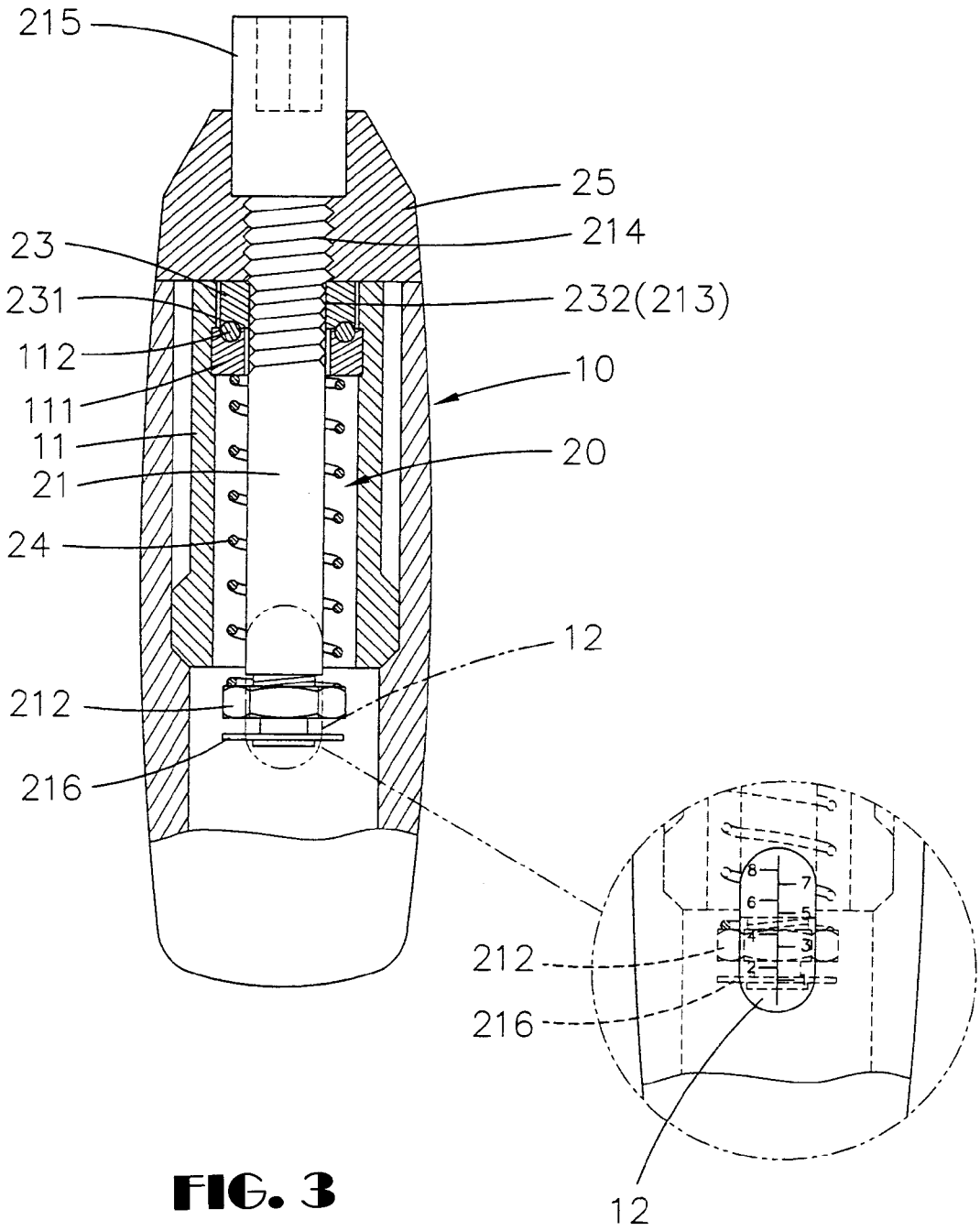
FIG. 3 is a sectional view of FIG. 2 where the shank has been removed.
Figure 4:
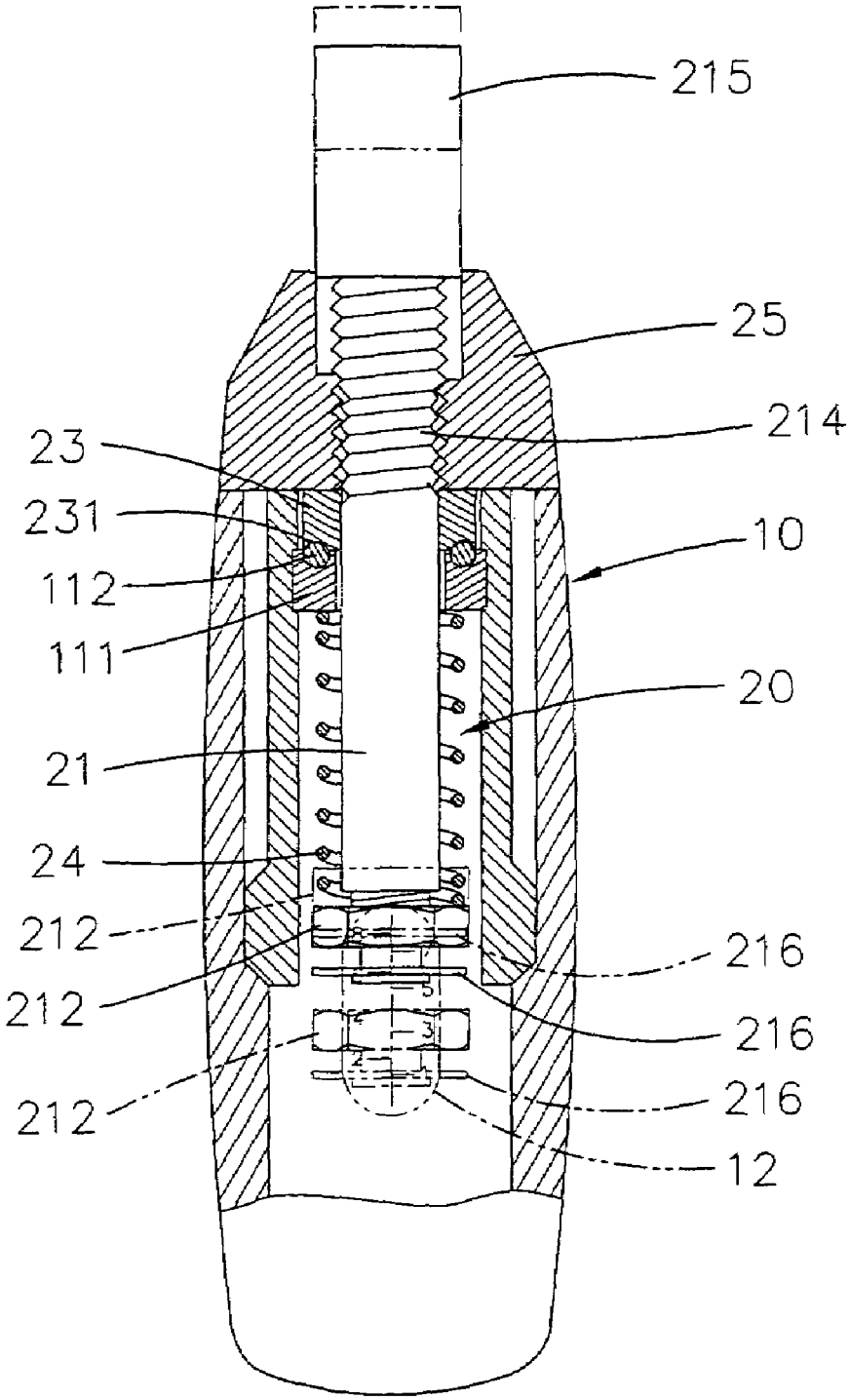
FIG. 4 is a view similar to FIG. 3 where torque set value is being set by rotating a torque adjustment ring.

Referring to FIGS. 1 to 4, a screwdriver in accordance with a first preferred embodiment of the invention comprises a torque setting mechanism 20 and a rotatable handle 10 with most portion of the torque setting mechanism 20 mounted therein. The handle 10 comprises a scale window 12 on its surface. The torque setting mechanism 20 comprises a sleeve 11 including a support ring 111 urged against an upper shoulder by a lower spring (e.g., compression spring) 24 as detailed later, the support ring 111 including a plurality of steel balls 112 equally spaced around its upper surface. The support ring 111 thus is able to turn as the sleeve 11 turns.

An actuation rod 21 has its most portion disposed in the sleeve 11 by passing the support ring 111 and the spring 24. The actuation rod 21 comprises a lower threaded section 211, an upper threaded section 214, two opposing intermediate flats 213 extended from the upper threaded section 214 to the lower threaded section 211, and a top socket 215 for securely receiving one end of a shank 91. A clutch ring 23 is snugly put on the flats 213 and has a lower surface formed with a plurality of equally spaced recesses 231 for receiving projected portions of the steel balls 112.

A torque adjustment ring 25 is rotatably provided on tops of both the clutch ring 23 and the handle 10 with the actuation rod 21 passed. The torque adjustment ring 25 comprises a lower knurled circular member 251 for facilitating gripping prior to turning. A shoulder between the upper threaded section 214 and the socket 215 is rested upon top of the torque adjustment ring 25.

A lower torque adjustment nut 212 is threadedly secured to the lower threaded section 211 and is provided under the sleeve 11 to urge against a bottom of the spring 24. Thus, as stated above the support ring 111 is urged upward by the spring 214. A color ring 216 is provided at a bottom of the actuation rod 21 and is disposed corresponding to the scale window 12. The color ring 216 is adapted to turn as the actuation rod 21 longitudinally moves in a torque setting operation by turning the torque adjustment ring 25. As such, a user may be visually aware whether a desired torque set value has been set or not by viewing the color ring 216 through the scale window 12.

Figure 5A:
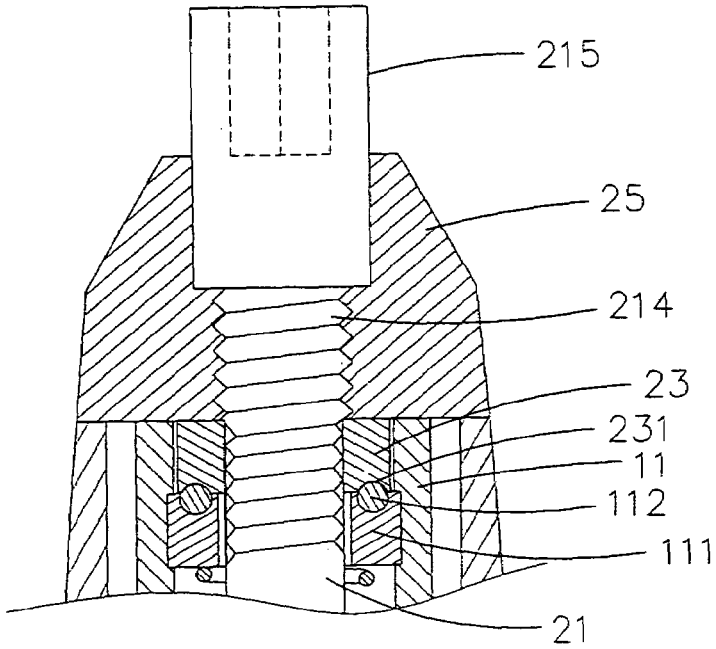
FIG. 5A is a view of upper portion of FIG. 3.
Figure 5B:
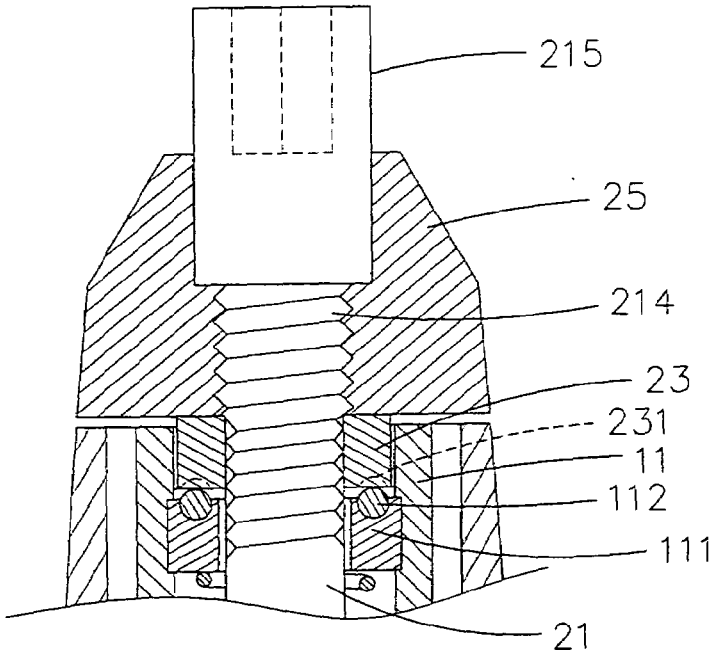
FIG. 5B is a view similar to FIG. 5A where a clutch ring disengages with steel balls when torque exceeds a set value.

Referring to FIGS. 5A and 5B, in operation a user may first mount a shank 91 at the socket 215. Next, fit an open end of the shank 91 into the head of a screw prior to turning the handle 10. The turning of the handle 10 will turn both the support ring 111 and the torque adjustment ring 25. The clutch ring 23 will disengage with the steel balls 112 (i.e., the torque adjustment ring 25 disengages with the handle 10 as the clutch ring 23 pushes the torque adjustment ring 25 upward) if the exerted force (i.e., torque) exceeds a set value (i.e., the exerted force larger than expansion force of the spring 24 when the screw has been fastened). Thus, turning of the steel balls 112 has no effect to the clutch ring 23. Also, the upward movement of the torque adjustment ring 25 will longitudinally move the actuation rod 21. As a result, torque exerted on the handle 10 will not transmit to the shank 91 so as to prevent the screw from being over-driven by the shank 91.

Referring to FIG. 4 again, for setting maximum torque values of different screws simply turn the torque adjustment ring 25 about the upper threaded section 214 to longitudinally move the actuation rod 21. Substantially, movement of the torque adjustment nut 212 closer to the support ring 111 will further compress the spring 24, and bring the clutch ring 23 to further engage the support ring 111. In short, turning the torque adjustment ring 25 can set a maximum torque value of a screw to be driven.

Figure 6:
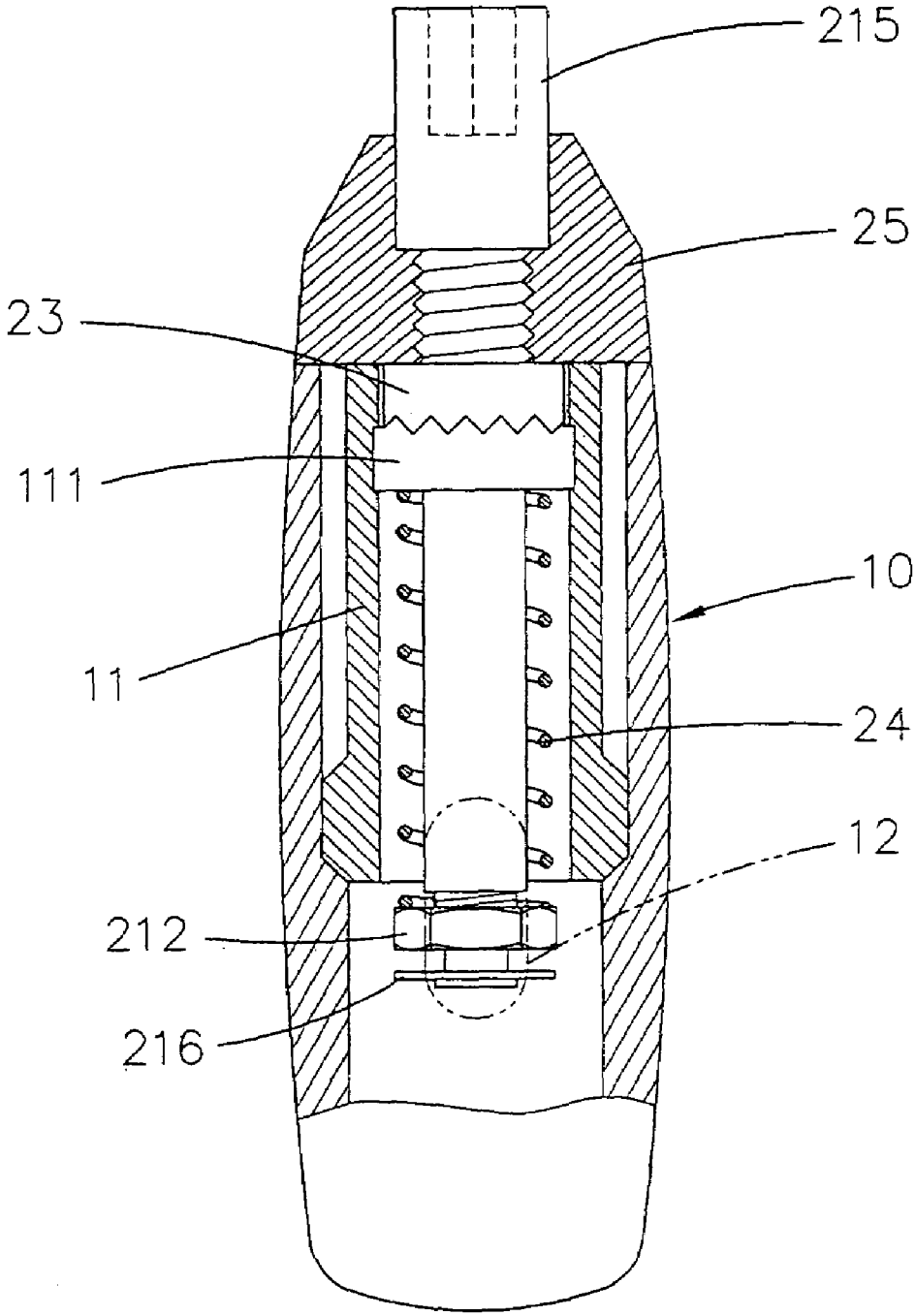
FIGS. 6 and 7 are views similar to FIG. 3 where second and third preferred embodiments of some components of the invention are shown.
Figure 7:
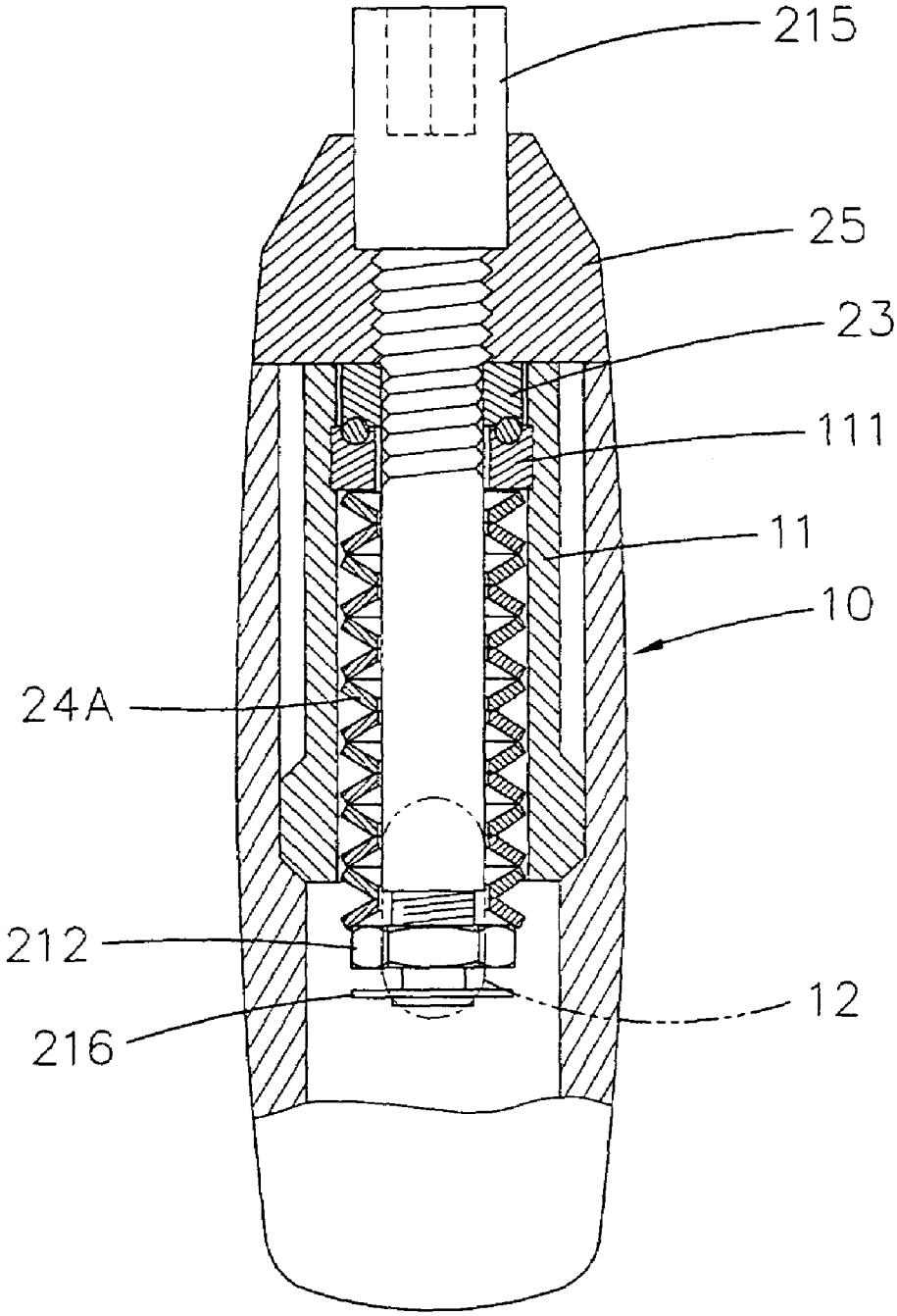

Referring to FIG. 6, the engagement of the support ring 111 and the clutch ring 23 by means of steel balls 112 and recesses 231 can be replaced by teeth and mated teeth. Referring to FIG. 7, the spring 24 can be replaced by a plurality of resilient rings 24A stacked together.

Figure 8:
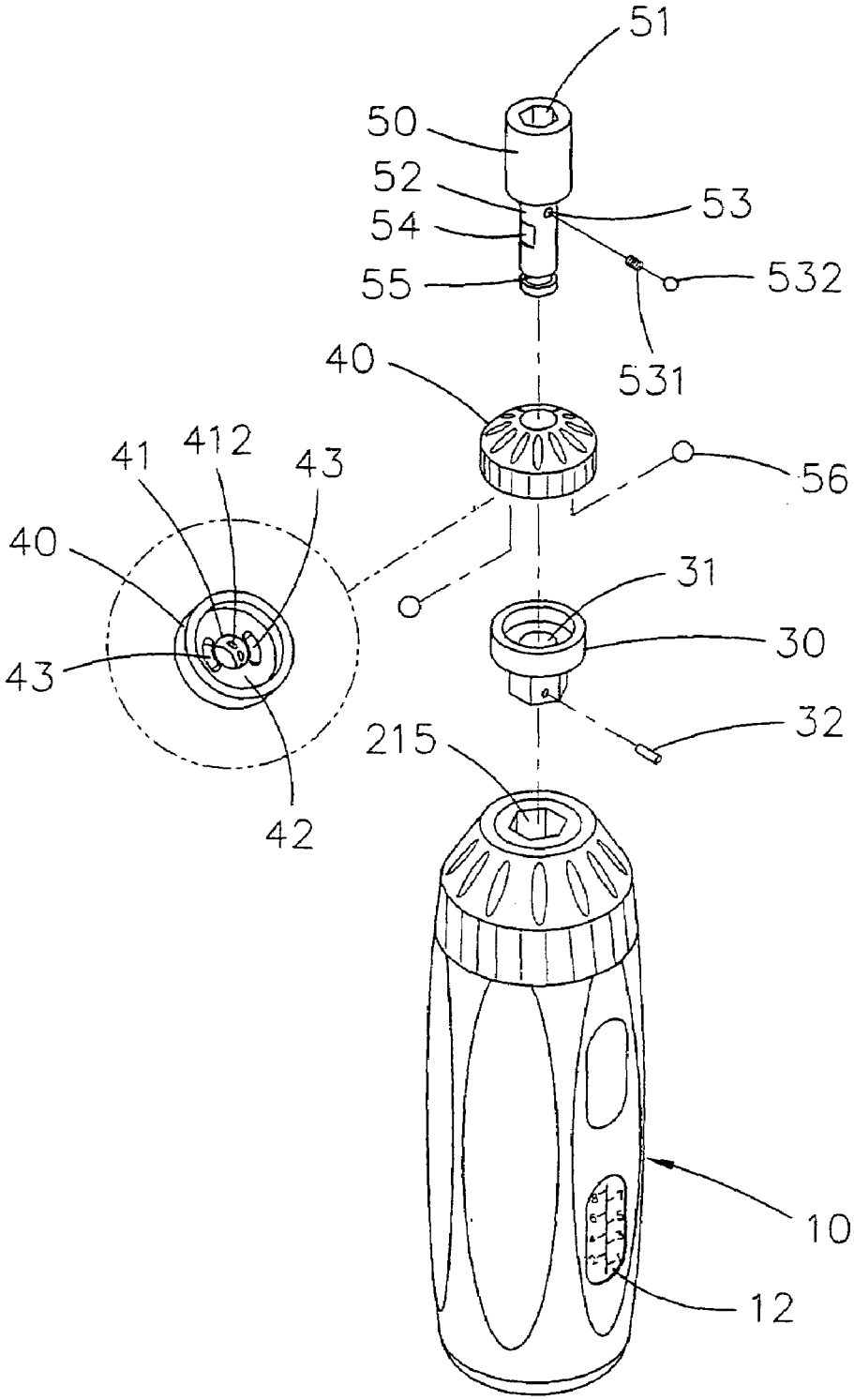
FIG. 8 is an exploded view of a fourth preferred embodiment of some components (e.g., turning direction change mechanism) of the invention.
Figure 9:
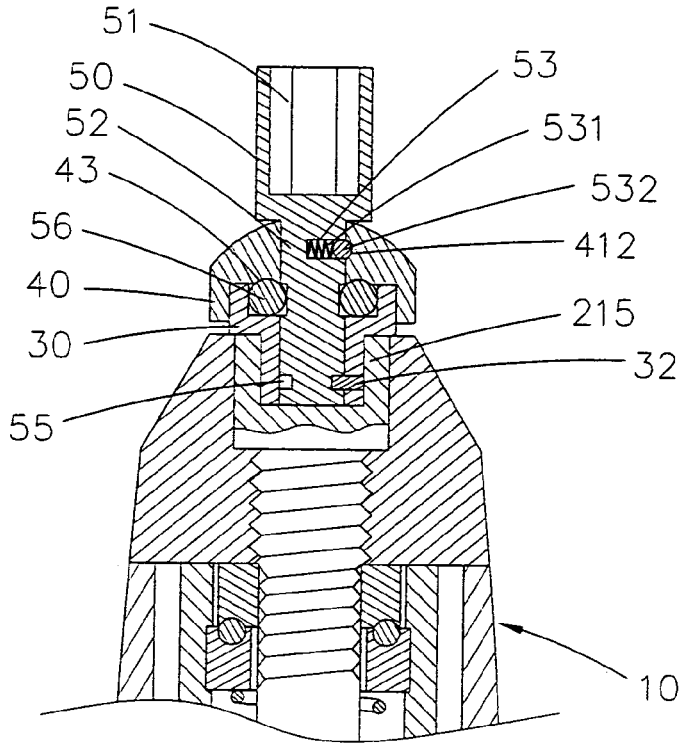
FIG. 9 is a longitudinal sectional view of upper portion of the assembled screwdriver in FIG. 8.
Figure 10:
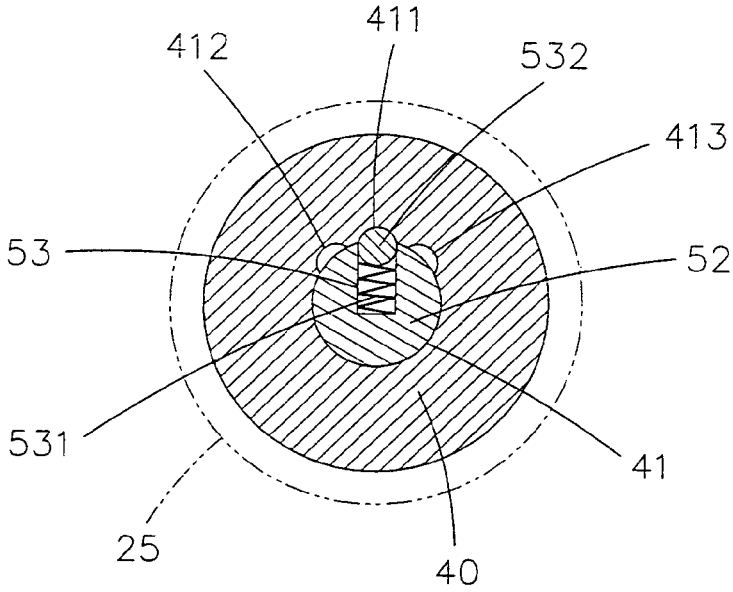
FIG. 10 is a transverse sectional view showing a relative position of steel ball of direction change member with respect to positioning aperture.

Referring to FIGS. 8, 9, and 10, a turning direction change mechanism as a fourth preferred embodiment of the invention is provided and comprises a hollow cylindrical seat 30 including a longitudinal hole 31 and a pin 32 snugly projected from a transverse through hole; a ring-shaped direction change member 40 fitted on the seat 30 and including a longitudinal hole 41 including first, second, and third positioning apertures 411, 412, and 413 on its inner surface 42, and two opposite arcuate cavities 43 with the longitudinal hole 41 disposed therebetween; a cylindrical auxiliary seat 50 including a top socket 51 for securely receiving one end of a shank, and a downward peg 52 extended into the longitudinal hole 31 through the longitudinal hole 41 and including a transverse aperture 53, a spring 531 fitted in the aperture 53, a steel ball 532 biased between the spring 531 and one of the first, second, and third positioning apertures 411, 412, and 413, two opposite flats 54 formed on a peripheral surface such that either steel ball 56 is adapted to snugly fit in a space defined by the flat 54, the seat 30, and the cavity 43, and an annular groove 55 proximate a bottom end of the peg 52. The pin 32 is projected into the groove 55 for permitting the auxiliary seat 50 to turn about the seat 30 without disengagement.

As shown in FIGS. 9 and 10, the direction change member 40 is adapted to turn clockwise or counterclockwise to cause the steel ball 532 to move from the first positioning aperture 411 into the third positioning aperture 413 or the second positioning aperture 412 for locking. Relative positions of other associated components about this turning are shown in FIGS. 11A, 11B, and 11C.

As shown in FIG. 11A, the steel balls 56 are located at centers of the cavities 43. In FIG. 11B, turning the auxiliary seat 50 counterclockwise will move one steel ball 56 to a first position P1 at one end of the cavity 43. The seat 30 also turns counterclockwise to form a gap between the steel ball 56 and the seat 30. As a result, force is exerted on the peg 52. In FIG. 11C, turning the auxiliary seat 50 clockwise will move one steel ball 56 to a second position P1 at the other end of the cavity 43. The seat 30 also turns clockwise. As a result, no force is exerted on the peg 52.

While the invention herein disclosed has been described by means of specific embodiments, numerous modifications and variations could be made thereto by those skilled in the art without departing from the scope and spirit of the invention set forth in the claims.

What is claimed is:

1. A screwdriver comprising:

a rotatable handle including a sleeve including an internal lower elastic member, a support ring urged against an internal shoulder by the elastic member, the support ring including a plurality of male members equally spaced around its upper surface, and a scale window on a surface of the handle; and a torque setting mechanism including an actuation rod passed through the support ring and the elastic member and including a lower threaded section, an upper threaded section, two opposing intermediate flats extended from the upper threaded section to the lower threaded section, and a top socket for securely receiving one end of a shank; a clutch ring put on the flats and having a plurality of equally spaced female members formed on its lower surface for receiving portions of the male members; a torque adjustment ring rotatably disposed on tops of the clutch ring and the handle with the actuation rod passed therethrough the torque adjustment ring urged against a shoulder between the upper threaded section and the socket; a lower torque adjustment nut threadedly secured to the lower threaded section and disposed under the sleeve to urge against a bottom of the elastic member; and a color ring disposed at a bottom of the actuation rod and disposed corresponding to the scale window, the color ring being adapted to turn as the actuation rod longitudinally moves in a torque setting operation by turning the torque adjustment ring; wherein:

in a screw fastening operation an open end of the shank may be fit into the head of a screw, turning of the handle may cause both the support ring and the torque adjustment ring to turn, the clutch ring will disengage with the male members to move the torque adjustment ring upward if a torque exerted on the screw by the shank exceeds a set maximum torque value, and the actuation rod will move longitudinally such that the torque will not transmit to the shank so as to prevent the screw from being over-driven; and in a maximum torque value setting, rotation of the torque adjustment ring about the upper threaded section to longitudinally move the actuation rod whereby moving the torque adjustment nut closer to the support ring will further compress the elastic member, and bring the clutch ring to further engage the support ring.

2. The screwdriver of claim 1, wherein the elastic member is a compression spring.

3. The screwdriver of claim 1, wherein the elastic member includes a plurality of resilient rings stacked together.

4. The screwdriver of claim 1, wherein the male members are steel balls and the female members are a plurality of recesses.

5. The screwdriver of claim 1, wherein the male members are teeth and the female members are mated teeth.

* * * * *